US006796614B1

(12) United States Patent
Paul

(10) Patent No.: US 6,796,614 B1
(45) Date of Patent: Sep. 28, 2004

(54) MODULAR FURNITURE UNIT

(76) Inventor: James Robert Paul, 589 Lucerne Place, North Vancouver, British Columbia (CA), V7N 3A6

( * ) Notice: Subject to any disclaimer, the term of this patent is extended or adjusted under 35 U.S.C. 154(b) by 0 days.

(21) Appl. No.: 10/420,792

(22) Filed: Apr. 23, 2003

(51) Int. Cl.[7] ..... A47C 7/00
(52) U.S. Cl. ..... 297/440.14; 297/118
(58) Field of Search ..... 297/440.14, 440.1, 297/440.15, 118, 440.16, 440.2, 440.21, 440.22; 5/12.2, 12.1

(56) References Cited

U.S. PATENT DOCUMENTS

| | | | | | |
|---|---|---|---|---|---|
| 1,408,114 | A | * | 2/1922 | Mathieu | 297/239 |
| 2,490,884 | A | * | 12/1949 | Rau | 297/440.15 |
| 3,036,864 | A | * | 5/1962 | Arai | 297/463.1 |
| 3,146,029 | A | * | 8/1964 | Gariepy | 297/440.15 |
| 3,578,385 | A | | 5/1971 | Stiglitz | |
| 3,608,959 | A | | 9/1971 | Sarvas | |
| 4,022,502 | A | | 5/1977 | Smith et al. | |
| 4,305,616 | A | | 12/1981 | Martinez | |
| 4,711,495 | A | | 12/1987 | Magder | |
| 4,917,439 | A | * | 4/1990 | Hutton | 297/440.16 |
| 5,112,110 | A | * | 5/1992 | Perkins | 297/440.21 |
| 5,295,275 | A | | 3/1994 | Sherman | |
| 5,344,216 | A | | 9/1994 | Suominen | |
| 5,842,743 | A | | 12/1998 | Wright et al. | |
| 5,890,767 | A | | 4/1999 | Chang | |
| 6,105,913 | A | | 8/2000 | Couture | |
| 6,135,562 | A | | 10/2000 | Infanti | |
| 6,367,874 | B2 | * | 4/2002 | Casini | 297/118 |
| 6,367,880 | B1 | | 4/2002 | Niederman et al. | |
| 6,401,282 | B1 | | 6/2002 | Shum | |

FOREIGN PATENT DOCUMENTS

| | | | | |
|---|---|---|---|---|
| CA | 2255114 | | 2/1999 | |
| GB | 2098688 A | * | 11/1982 | F16L/39/00 |

OTHER PUBLICATIONS

Zanotta S.p.A. "Europa" Brochure, Undated.
ScanDesigns Fine Furniture "caméléon" Advertisement, Undated.
Cantù Interiors "Italian Collection" Advertisement, Undated.
Advertisement "New Inform Products", p. 13 Azure, Mar./Apr. 98.
"metro" Brochure, Apr. 1, 1999.
Printout of purported Oct. 24, 2001 archived version of www.jensen–lewis.com/html/sofascameleon.html website printed on Jun. 24, 2003, from www.archive.org.
Printouts made on May 14, 2003 from www.merchantmanager.com/ita6377/MM001.ASP?pageno=758 and http://www.italydesign.com/onlinestore/pages/esf$_{13}$dir?001.html re "Freedom Sofa System".
Printouts made on Jun. 24, 2003 from www.jensen–lewis.com/html/sofascameleon.html website re "Cameleon Sofas".
Printout from archive.org, showing dates of purported archived versions of www.jensen–lewis.com/html/sofascameleon.html on certain dates.
Printouts of HTML files downloaded on Apr. 3, 2003 from www.jensen–lewis.com/html/sofascameleon.html.
Printouts of HTML files downloaded on Feb. 23, 2003 from www.merchantmanager.com/ita6377/MM001.ASP?pageno=758.

* cited by examiner

*Primary Examiner*—Milton Nelson, Jr.
(74) *Attorney, Agent, or Firm*—Oyen Wiggs Green & Mutala

(57) ABSTRACT

A modular furniture unit is disclosed. The furniture unit includes a base which is capable of releasably securing various furniture modules. The base frame has walls with a plurality of slots for accommodating the insertion of tongue portions extending from the furniture modules. The slots are accessed through the base's cover which may be opened and closed at various locations, for example, by a continuous two-way zipper having a plurality of pull tabs. The cover is opened in selected locations to allow insertion of the tongue portions into the slots, but is otherwise closed to hide the unused slots. The furniture modules can be easily and conveniently removed and repositioned allowing the units to be reconfigured. The tongue may be retained in the slots by a downwardly angled relationship between the slots and the tongues.

28 Claims, 13 Drawing Sheets

MODULAR FURNITURE UNIT

TECHNICAL FIELD

This invention relates to modular furniture units such as sofas, beds, chairs and loveseats.

BACKGROUND

A sofa is traditionally constructed with a seat base section permanently fastened to armrest and backrest sections and then upholstered. The finished sofa is then transported for storage or display in a store. However, a finished sofa occupies a relatively large amount of space, meaning that it is inefficient to transport and store finished traditional sofas.

It is known to provide modular furniture pieces that can be assembled by fastening pre-upholstered components to one another. A modular sofa is more convenient and efficient to store and transport than a traditional sofa since the constituent elements can be disassembled for shipment between the manufacturing facility and the store or between the store and a consumer's dwelling place. Also, heavy or awkwardly-shaped sofas may be difficult or impossible to move through certain doorways, hallways or staircases, whereas modular furniture can be moved first and then assembled at a destination. From a shipping perspective, the amount of furniture that can be packed within a particular space increases where large furniture units can be disassembled, thereby reducing shipping and transport costs.

Some existing modular furniture involve units assembled by fastening the constituent components together using a plurality of fastener arrangements (e.g. nut and bolt) that typically require tools. It would be advantageous to be able to quickly and easily assemble and disassemble the components without the need to utilize tools.

It would also be advantageous for a furniture piece to be capable of being reconfigured by adding, removing or repositioning certain of the constituent components in order to change the appearance or functional capacity of the furniture unit. However, most prior art modular furniture pieces are capable of being assembled in only one manner, without any regard for later changing the appearance or functionality of the furniture piece.

There is a sofa sold under the trademark CAMËLËN™ which includes backrest and armrest portions which can be interchanged and repositioned relative to a seat base. In the CAMËLËN™ sofa, the backrest and armrest portions have a downwardly extending post which is received within apertures within the sofa seat base. A disadvantage with this arrangement is that the apertures are exposed on the top surface of the seat base when they are not utilized.

The need has therefore arisen for a modular furniture unit that is multi-functional and capable of being reconfigured or reshaped by quickly and easily adding, removing or repositioning constituent furniture modules.

SUMMARY OF INVENTION

In accordance with one aspect of the invention a furniture unit with a base is disclosed. The base is for supporting a cushion thereupon. The base has a frame capable of releasably securing at least one furniture module having at least one tongue portion with a free end. The frame has a plurality of interconnected upright walls and at least one of the walls defines a plurality of slots therethrough. The slots are dimensioned for insertion of the free end of the tongue portion to releasably secure the furniture module to the base.

The walls are covered by a cover member which has a gap therein for providing access to insert the tongue portion into the slots to releasably secure the furniture module to the base. The cover member also has means for opening and sealing the gap, such as a continuous two-way zipper, strips of self-gripping fabric, buttons, snaps or the like. The furniture unit may have one or more furniture modules, including back wall members, side wall members, armrest members, backrest members, footrest members, seat cushion extension members, base members and combinations thereof. The furniture unit can be configured to form a bed, sofa, sectional. chair or loveseat. The cover member may be made from leather or a fabric material.

Preferably, the slots extend substantially the length of the wall in a side by side linear arrangement. Preferably each of the walls have a plurality of slots extending substantially the length of the walls side by aide linear arrangements. Preferably the linear arrangements have a common vertical position so that a linear arrangement of the slots extends substantially around the perimeter of the frame.

The furniture unit may include means for releasably retaining the tongue portions within the slots to releasably secure the furniture module to the frame. In one aspect of the invention, the tongue portion and slots may each have a downwardly angled orientation, preferably approximately 110°. The tongue portion and slots may also be horizontally oriented. In another aspect of the invention, the frame may comprise flanges attached to the walls and positioned on edges of the slots for engagement with at least one kerf defined in the tongue portions. Two flanges may be positioned on opposite edges of each slot and kerfs may be defined in the top and bottom surface of the tongue portion. In another aspect of the invention, the frame may also have pins positioned proximal to the slots on the interior of the frame. In this aspect of the invention, the tongue portion has an aperture therein for accommodating the insertion of a pin when the tongue portion is inserted into a slot. The pins may be attached to and extending downwardly from top ties attached to and extending downwardly from upper portions of the frame walls. In another aspect of the invention, the furniture module may have a locking tab positioned near the free end of the tongue portion, the locking tab having a width smaller than the height of the slots and a height greater than the height of the slots. The locking tab is turned perpendicularly to the slots by means of a knob on the exterior of the furniture module after insertion of the free end of the tongue into a slot. The knob may be operatively connected to the locking tab by a rod extending through the furniture module. The rod may be a straight rod attached at a first end to the knob and attached at a second end to the locking tab.

The tongue portion may be part of a generally L-shaped bar which has its upright portion secured to a rigid frame member within a furniture module. A furniture module may have two tongue portions.

The base may be utilized as part of a convertible sofa-bed unit in another aspect of the invention. The unit forms a sofa having side and back walls by releasably securing side wall members and back wall members to the base through the insertion of the tongues into the slots. The unit forms a bed when the side wall members and back wall members are released from the base by removing the tongue portions from the slots.

In yet another aspect of the invention, the base may also be utilized as part of a modular furniture system capable of forming a plurality of different furniture units. Furniture modules may be repositioned and releasably secured at a plurality of different locations on the base frame to provide for many different configurations.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Like elements are indicated herein by the same reference numbers throughout the description.

Figure 1:
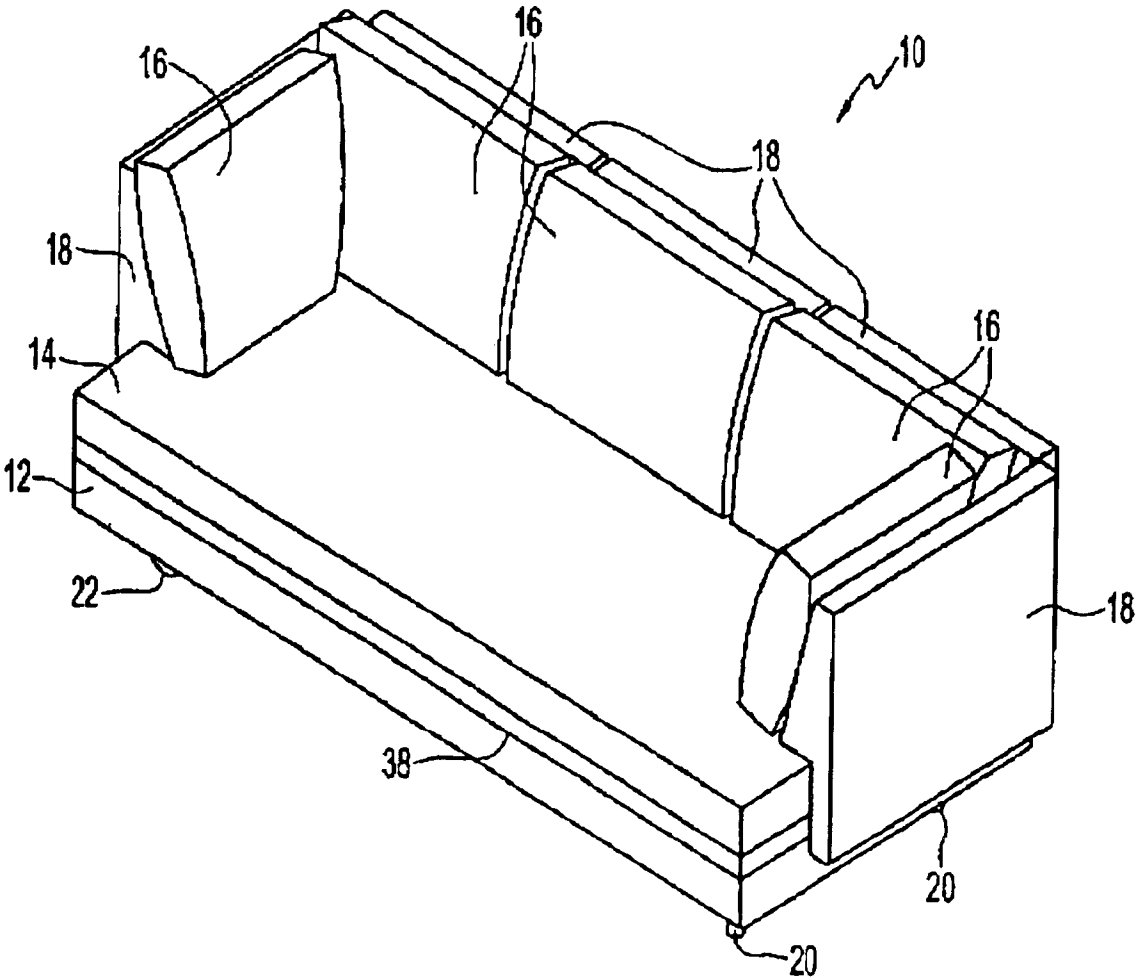
FIG. 1 is a perspective view of a sofa according to this invention.

FIG. 1 illustrated a sofa 10 according to this invention. Sofa 10 includes a base 12, seat cushion 14, cushions 16, side wall members 18 and back wall members 18, legs 20 and castors 22 (though only one castor 22 is illustrated in FIG. 1, it will be appreciated that sofa 10 includes two).

Seat cushion 14 and side and back cushions 16 may be constructed of any number of known materials such as, for example, a dense foam pad covered by a fabric material such as cotton or leather. Other materials could be used in the construction and upholstery of the cushions as are well known in the art. Legs 20 and castors 22 can be attached to base 12 in any suitable manner such as being screwed into sockets (not shown) on the underside of base 12, such as into blocking members 56 or stretchers 64.

Figure 2:
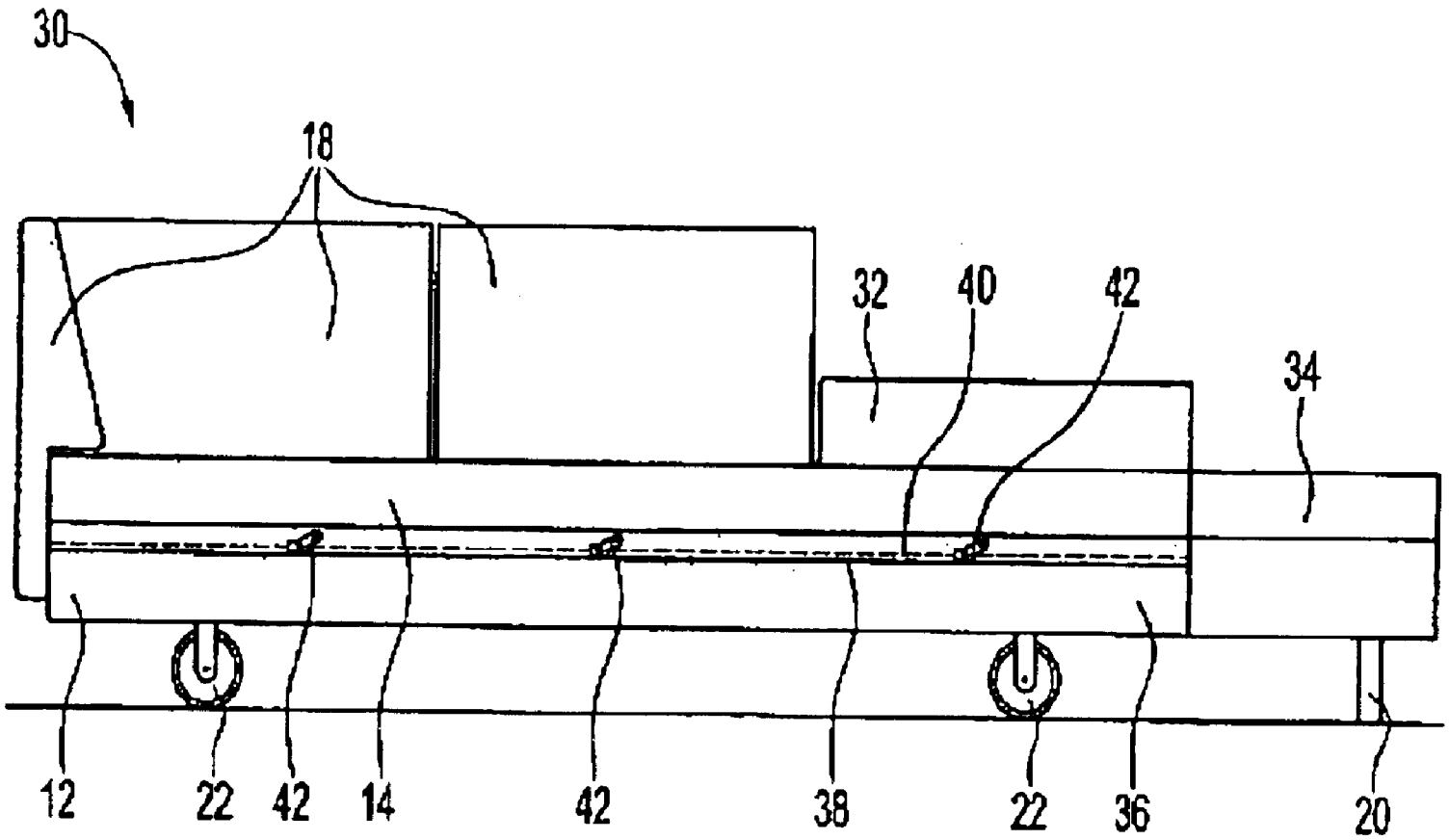
FIG. 2 is a front elevational view of a sofa according to this invention with a different configuration than the sofa depicted in FIG. 1.

FIG. 2 illustrates a sofa 30 having a different configuration than sofa 10 in FIG. 1. Sofa 30 includes four castors 22 (only two of which are illustrated), base 12, seat cushion 14 and three sofa wall members 18. Sofa 30 is shown without cushions 16 for illustration purposes. Sofa 30 also includes a sofa wall member 32 which has a shorter profile than sofa wall members 18. Wall member 32 is used to support a cushion (not shown) having a shorter profile than cushions 16, or alternatively, wall member 32 could be used as an armrest. Sofa 30 also includes rounded extension member 34 (see also FIGS. 7D and 7E). Extension member 34 is supported by a single leg 20 and is secured to base 12 in a manner that will be described. Extension member 34 functions as an extra seat for sofa 30, or as a foot rest for a person lying on sofa 30. Extension member 34 may be upholstered with the same fabric as the cushions on sofa 30.

The upright walls 46, 48, 50, 52 of the frame 44 of base 12 are covered by a cover member 36. Cover member 36 may be made from any material, fabric or textile which are well known in the furniture industry to cover or upholster furniture, including leather, wool, cotton, synthetic materials or other suitable materials. Cover 36 is designed with a gap or alit 37 extending horizontally around the perimeter of base 12. The gap 37 is sealed by a continuous two-way zipper 40. Cover 36 also includes a hanging flap 38 which can be lifted to expose continuous two-way zipper 40 which runs around the perimeter of base 12. Zipper 40 can be used to open and seal the gap 37 in cover 36 to provide access within base 12. Zipper 40 includes numerous pull tabs 42 which permit zipper 40 to be opened at numerous different locations. Flap 38 hangs down far enough to hide zipper 40 from view, but can be lifted to expose zipper 40 when it is desired to access the interior of base 12. For illustration purposes pull tabs 42 are shown in FIG. 2, however, it will be appreciated, particularly from FIG. 1, that flap 38 hangs down far enough to also hide pull tabs 42 from view.

Figure 3:
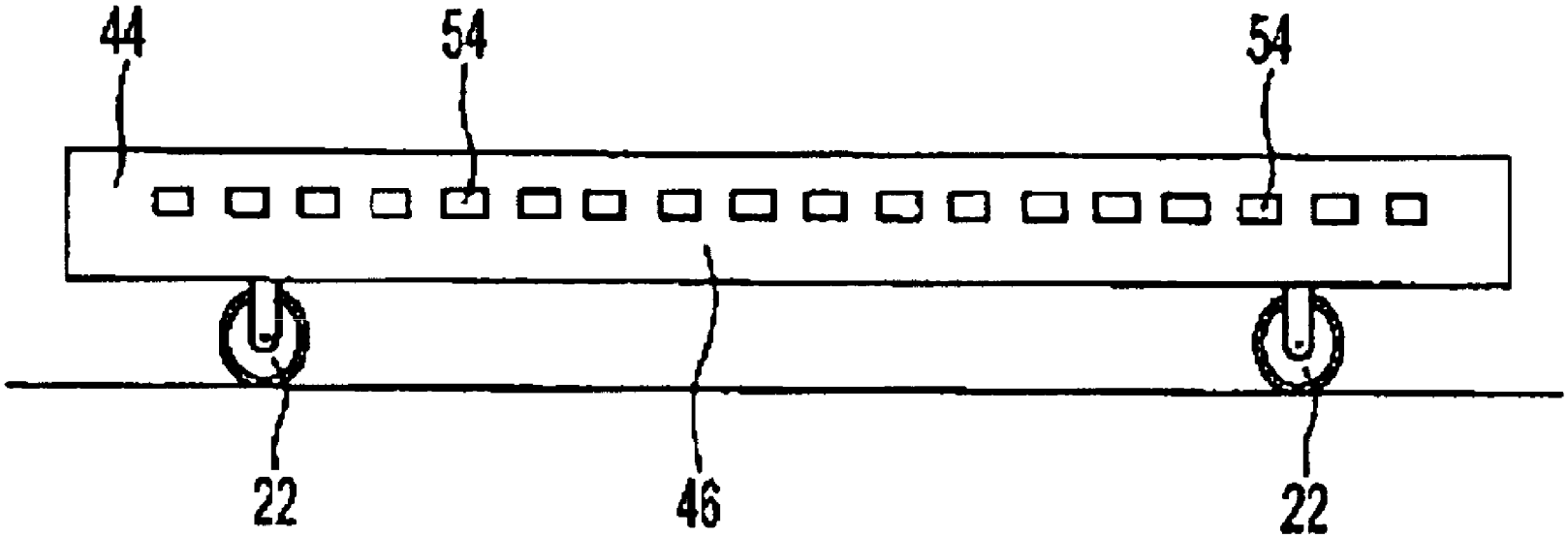
FIG. 3 is a front elevational view illustrating the base frame of the sofa of FIG. 2 without fabric.
Figure 4:
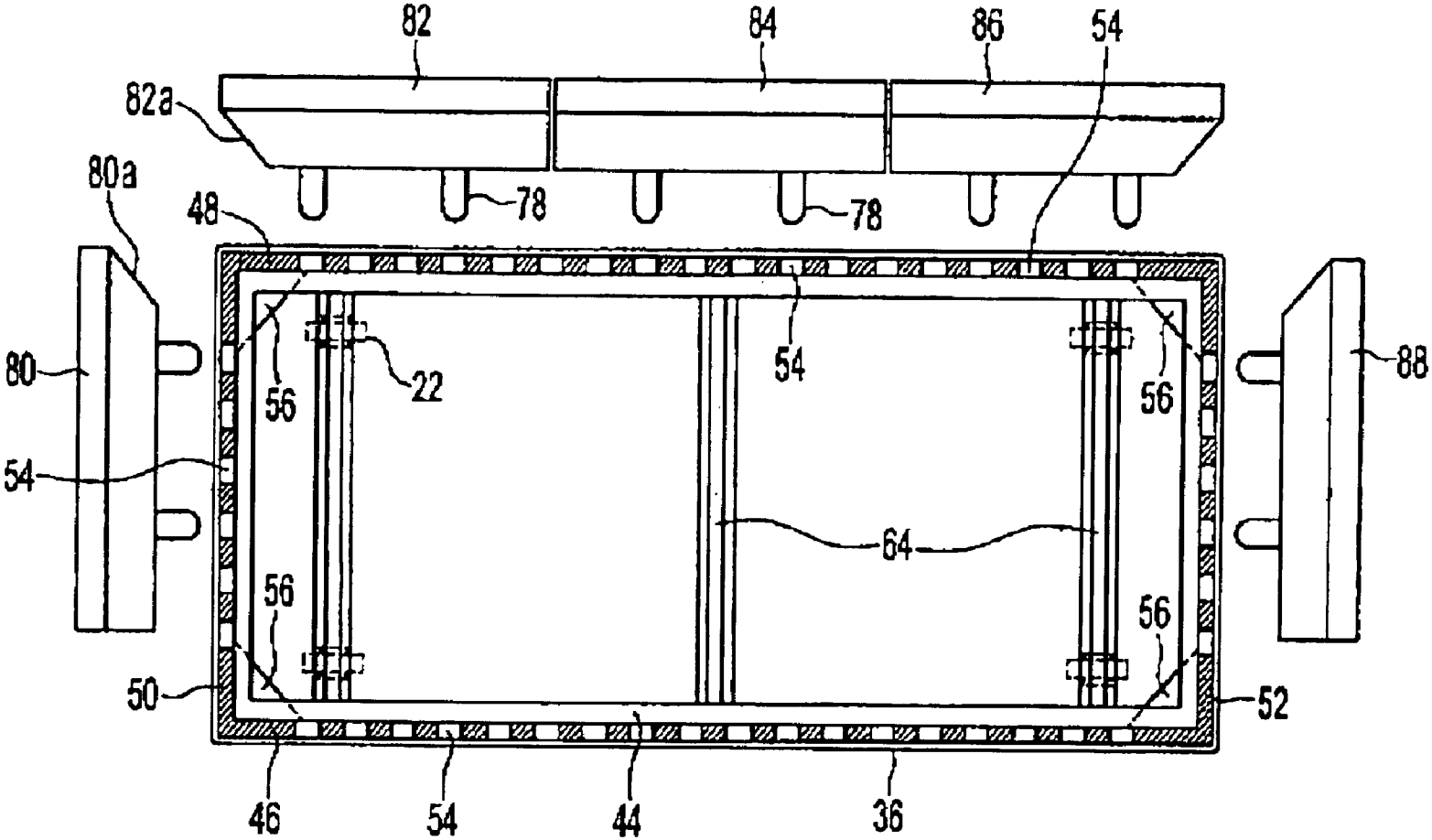
FIG. 4 is a top plan, partial section view of the base frame with five detached furniture modules wherein a cross sectional view base frame is illustrated and a top plan view of the furniture modules is illustrated.

Referring to FIGS. 3 and 4, base 12 includes an internal rectangular frame 44 underneath cover 36. Frame 44 is preferably constructed of wood, though other materials such as metal could also be used. Frame 44 includes up right front wall 46, upright back wall 48, and interconnecting upright side walls 50, 52. Frame 44 also includes stretchers 64 which extend across the depth of frame 44 and blocking members 56. Frame 44 supports seat cushion 14 thereupon. Seat cushion 14 may be used to sit or lie upon. The top surface and underside of frame 44 are also preferably covered with suitable materials. A fabric dust cover 63 may cover the underside of frame 44 and a synthetic stretch webbing 67 may cover the top surface of frame 44. Seat cushion 14 may be held in place on top of webbing 67 with corresponding strips of self-gripping fabric such as VELCRO™ or the like. Alternatively, a single cover member could be used to cover both seat cushion 14 and base 12. Cover 36 covering the walls of frame 44 and dust cover 63 and stretch webbing 67 may be attached into a single unit for covering frame 44, or alternatively they may be separate pieces individually secured to the frame with suitable means. High density foam 47 is positioned between cover 36 and the walls 46, 48, 50, 52 of frame 44 for shaping purposes. A perimeter edge roll of foam 49 surrounds the upper-most corners of frame 44 under cover 36 to round those corners.

Walls 46, 48, 50 and 52 each have a plurality of slots 54 defined therethrough (FIG. 3 shows only front wall 46, but FIG. 4 shows walls 46, 48, 50 and 52). It will be appreciated however that as few as only one of the frame walls could have slots 54 defined, therein to practice the invention, though it is preferable for all of the walls to have slots 54 defined therein. Slots 54 are preferably in a side to side linear arrangement extending substantially the length of each of the walls 46, 48, 50 and 52 (see FIG. 3 for wall 46). Preferably the linear arrangements of slots 54 are positioned at a common vertical position on each of the walls 46, 48, 50, 52. The gap 37 in cover 36 can be opened by means of zipper 40 to provide access to slots 54 of frame 44.

Figure 5:
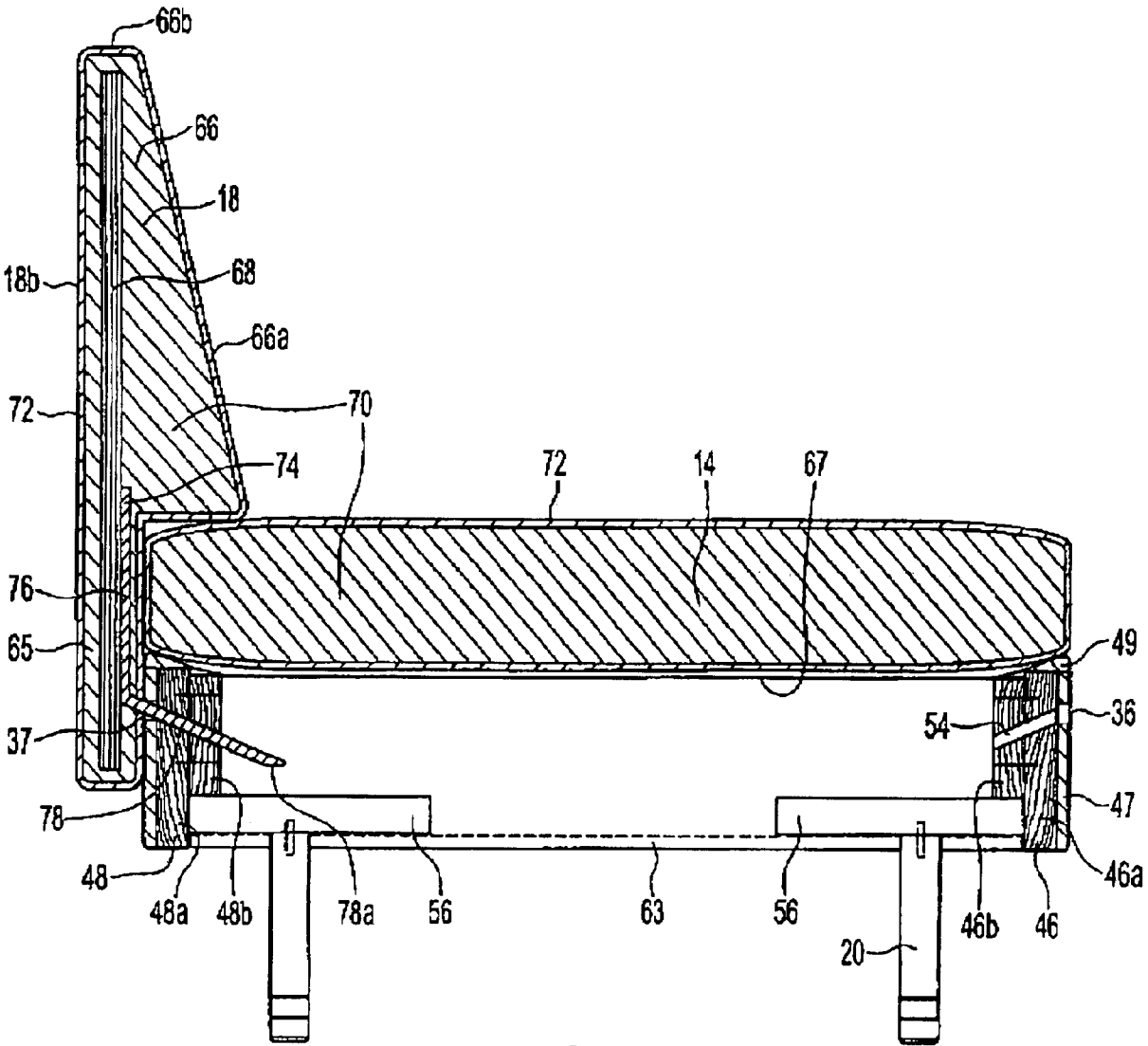
FIG. 5 is a cross section view of a sofa according to this invention such as the sofas illustrated in FIGS. 1 and 2 wherein a furniture module is releasably secured to the base frame.
Figure 6:
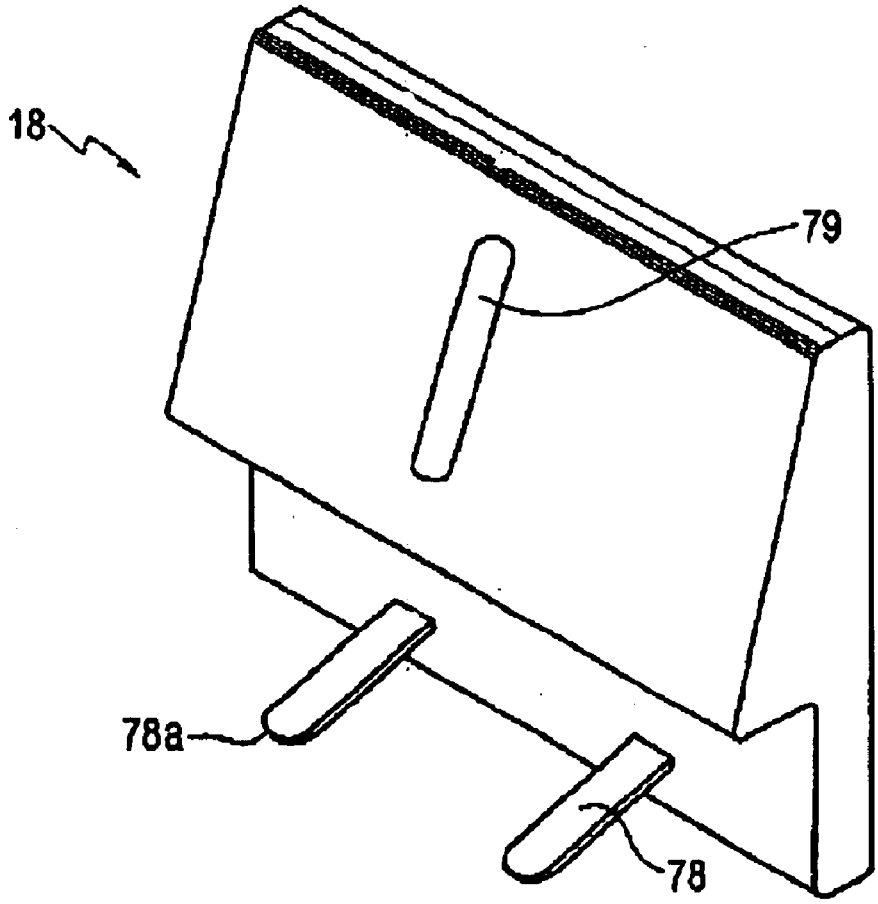
FIG. 6 is a perspective view of the furniture module illustrated in FIG. 5.

FIGS. 5 and 6 illustrate sofa wall member 18. Wall member 18 includes a lower portion 65 and an upper portion 66. Lower portion 65 is vertical and flat whereas upper portion 66 has a generally right-triangle profile with the hypotenuse 66*a* slanting towards the back 18*b* of the wall member 18. The slant of upper portion 66 provides a slight recline for a person sitting on sofa 10 or 30 to enhance comfort. The top 66*b* of upper portion 66 is slightly flattened and rounded for a pleasing aesthetic finish.

Wall member 18 includes a rigid frame member 68 which may be constructed of plywood or some other suitable material. Frame member 68 extends substantially the height and width of wall member 18 to provide structure. The interior of wall member 18 is filled with a suitable material, such as high density foam 70, in order to provide the desired profile and cushioning. Support member has an exterior cover 72, which can be made of any suitable material having regard to durability and the aesthetic appearance sought. It may be desired for wall members 18 to have a contrasting exterior appearance from the cushions on a sofa. FIG. 5 illustrates that seat cushion 14 may have the same interior foam 70 and cover 72 as wall member 18.

Wall member 18 also includes two L-shaped bars 74, each having an upright portion 76 and a tongue portion 78. Tongue portion 78 has a rounded free end 78*a*. L-shaped bars 74 may be constructed of aluminum or other suitable material. Upright portion 76 is secured to frame member 68 by means of screws (not shown) or other suitable fasteners. Tongue portion 78 extends from vertical portion 76 for insertion into a slot 54 as illustrated in FIG. 5. Walls 46, 48 are shown in FIG. 5 as each being constructed of two attached wood rails 46*a*, 46*b* and 48*a*, 48*b*. The walls of the frame may be constructed of a single member. The walls may also so be constructed with a thicker or thinner width. Free end 78*a* of tongue portion 78 is fully inserted through gap 37 in cover 36 and slot 54 in frame 44. Tongue portion 78 is downwardly angled relative to vertical portion 76. Slots 54 are also similarly angled for accommodating the insertion of tongue 78. Preferably tongue portion 78 is downwardly angled to approximately 110°. The combination of the downward angled orientation of tongue portions 78 and slots 54 releasably secures member 18 to frame 44. Tongue portion 78 is thereby retained in slot 54.

Insertion of tongue portions 78 into slots 54 secures sofa wall 18 to frame 44, and thus base 12. The angled relationship between tongue portion 78 and slots 54 provides a stable and secure backing for sofa 10. A user may sit on sofa 10 and lean against wall member 18 (with or without an intervening cushion 16) and wall member will not be released from frame 44 due to the angled relationship between tongue portions 78 and slots 54. Support member 18 can however be easily and readily released from frame 44 when desired by a user lifting the support member 18 with an upwardly angled pull to slidingly release tongue portions 78 from slots 54. The ease and convenience in releasing support members 18 from frame 44 when disassembly or repositioning is desired is an improvement over prior art furniture units designs which require a user to remove a seat cushion to access a hollow interior of the frame in order to remove number of fasteners which secure the arm and back rests to a base. The present invention allows support members to be removed with ease and convenience, while still providing backing stability for the sofa.

Wall members 18 and cushions 16 may have corresponding strips 79 of self-gripping fabric such as VELCRO™ to maintain cushion 16 in place against wall member 18. In such an arrangement, the VELCRO™ strip 79 would be positioned on the front face 66*a* of the upper portion 66 of wall member 18, and a corresponding VELCRO™ strip (not shown) would be positioned on the back of cushion 16.

FIG. 4 illustrates five sofa side and back wall members 80, 82, 84, 86, 88 ready to have tongue portions 78 inserted into slots 54 of frame 44. Tongue portions 78 are illustrated in dotted outline. Wall member 84 is shaped similar to support member 18 shown in FIG. 6, while wall members 80 and 82 have opposed bevels 80*a* and 82*a* to form a corner once secured to the frame 44. Wall members 86 and 88 have similar opposed bevels to form another corner.

In operation, one or more wall members 18 are releasably secured to frame 44 of base 12 by inserting tongue portions 78 through gap 37 in cover 36 into slots 54 formed in the walls of frame 44. Access to the slots 54 is achieved by opening gap 37 in cover 36 by means of continuous two-way zipper 40. Multiple pull tabs 42 permit the cover 36 to be opened in selected locations corresponding to the slots of interest. The remainder of gap 37 remains closed (by means of zipper 40), and hidden beneath cover flap 38. This is illustrated in FIG. 5 where tongue portion 78 is inserted through a slot 54 in wall 48, whereas cover 36 (by means of zipper 40) covers a corresponding slot 54 in front wall 46. FIG. 5 also illustrates that tongue portions 78 and L-bar 74 remain hidden from view when furniture module 18 is releasably secured to the base 12. The use of cover 36 and the ability to seal the gap 37 in cover 36 by means of zipper 40 thus hides slots 54 from view, rendering an improvement over prior art designs where apertures or recesses are visually exposed when not in use.

The plurality of slots 54 defined in the walls of frame 44 permit furniture units according to this invention to be flexible in appearance and function. Numerous configurations are possible. For example, a particular wall member 18 could be secured to base 12 at numerous locations along a particular wall by inserting the tongue portions 78 into particular slots 54. The same support member could be repositioned to a different location along the same wall, or a different wall, by lifting the support member and, after opening cover 36 by zipper 40 at the desired location, inserting the tongues into two different slots.

Furniture modules other than sofa wall member 18 could be releasably secured to base 12 by means of the tongue and slot arrangement discussed above. For example, it may be desired to use a wall member 32 having a shorter height than support member 18. Rounded extension member 34 (illustrated in FIGS. 2, 7D and 7E) is another example of a furniture module that could also be secured to base 12 by means of the tongue and slot arrangement of this invention.

For rounded extension member 34, tongue portions 78 are secured to an internal frame (not shown) in such a manner to permit the tongues 78 to extend from the flat surface 34*a* at a downwardly angled orientation similar to the extension of tongue 78 from flat portion of support member 18, and thus capable of free ends 78*a* being inserted into slots 54. Once inserted, the tongues 78 of the extension member 34 would secure the extension member against the base 12 in the manner discussed above.

Figure 7C:
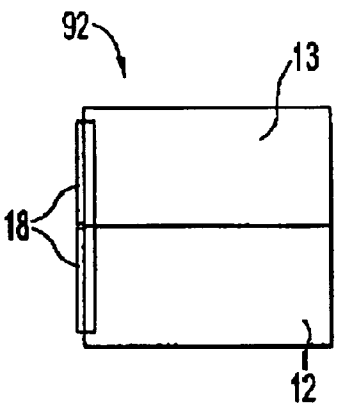
FIGS. 7A–7E are schematic top views illustrating various furniture units according to this invention with differing configurations.
Figure 7B:
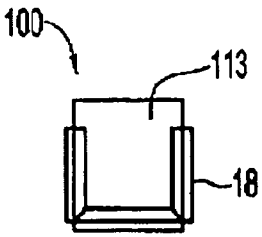
Figure 7A:
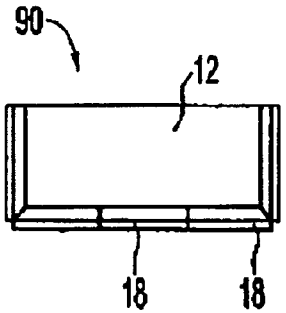
Figure 7E:
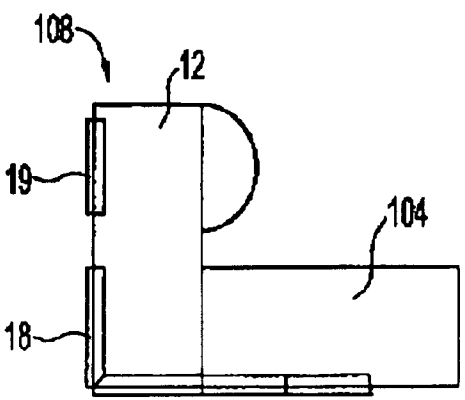
Figure 7D:
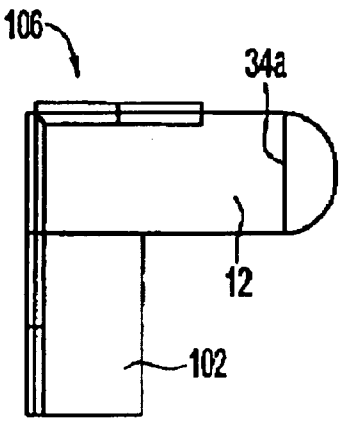

FIGS. 7A–7E are schematic drawings illustrating the flexibility and multifunctionality of furniture units according to this invention. FIG. 7A illustrates a sofa arrangement 90 with base 12 and five side and back wall members 18, four of which have opposed bevels for the corners. FIG. 7B illustrates a chair arrangement 100 with three support members 18 releasably secured to a square shaped base 113. FIG. 7C illustrates a double bed arrangement 92 having two bases 12, 13 and support members 18 forming a headboard. Base 13 could be identical to base 12, in which case it would simply be placed beside base 12 in a double bed arrangement. Alternatively, base 13 could be fitted with tongues 78 similar to extension member 34 if it is desired to releasably secure base 13 to base 12. As used herein, "base member" refers to a second base that is fitted with one or more tongue portions for releasably securing the base member to a first base. FIGS. 7D and 7E illustrate sectional arrangements 106, 108 of differing configurations, each including base 12, extension member 34, support members and a second base 102, 104, respectively, which may be placed beside or releasably secured to base 12 in the manner discussed above (in the latter case, 102, 104 would be referred to as base members 102, 104). Base 102 is illustrated as having a smaller dimension than base 12. FIG. 7E illustrates that the sofa wall members can be positioned at different locations along a wall of base 12. In this case one wall member 19 is spaced from the other support members 18. In this configuration, zipper 40 having multiple tabs 42 could be used to open the gap in cover 36 to allow insertion of the tongue portions of members 18 and 19 and to close the gap in cover 36 in all other locations, including between members 18 and 19. Rounded extension member 34 could be used as footrest for a person leaning against support member 19 in sectional 108.

It will thus be appreciated that furniture units according to this invention can have multiple functions and configurations, the most basic configuration being a single bed comprising base 12 with seat cushion 14 thereon (for use as a mattress) without having any additional furniture modules secured to the base. Numerous other configurations and furniture units could be created by releasably securing one or more furniture modules to the base in different positions.

Figure 8A:
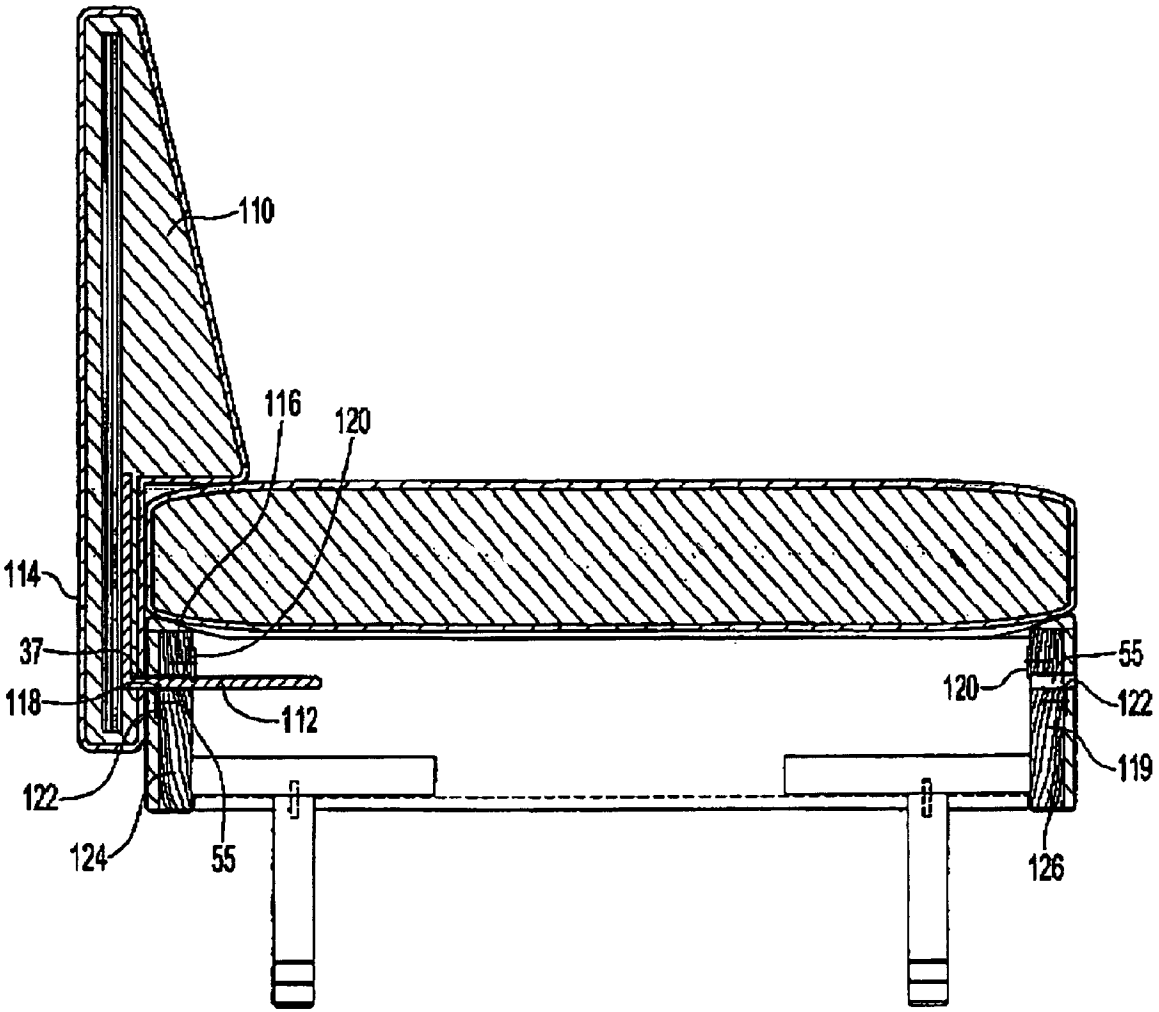
FIG. 8A is a cross section view of a sofa according to this invention such as the sofas illustrated in FIGS. 1 and 2, illustrating an alternative embodiment of the tongue and slot arrangement illustrated in FIG. 5 used to releasably secure a furniture module to the base frame.
Figure 8B:
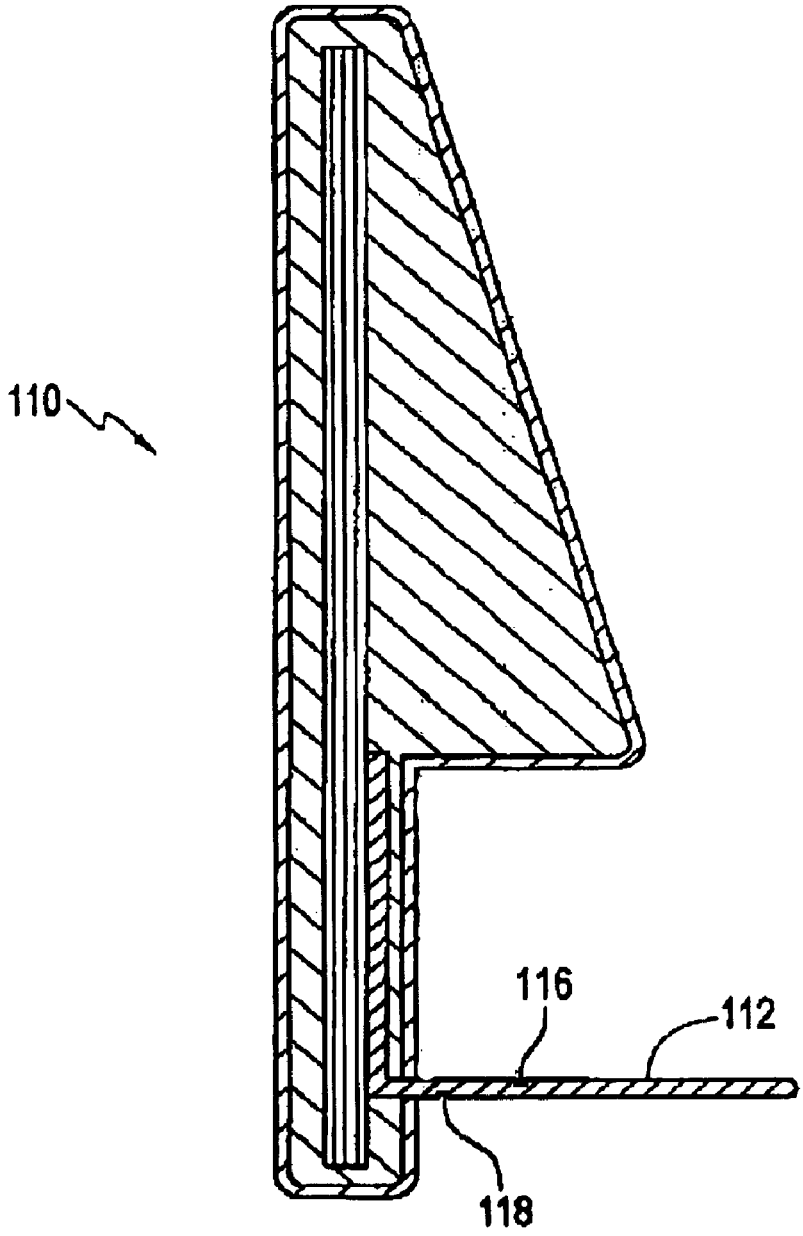
FIG. 8B is a cross section view of the furniture module illustrated in FIG. 8A.

FIG. 8A illustrates an alternative embodiment of the tongue and slot arrangement illustrated in FIG. 5 and 6. wall member 110 is similar to support member 18, except that tongue portion 112 extends horizontally from the lower portion 114 of wall member 110 rather than being downwardly angled like tongue portion 78. Tongue portion 112 also has two kerfs 116, 118 defined in its top and bottom surfaces. Slots 55 in this arrangement are horizontally oriented to accommodate the insertion of tongues 112 rather than being downwardly angled like slots 54. walls 124 and 126 are also fitted with flanges 120, 122 on either side of slots 55 to engage the two kerfs 116, 118. Planges are secured to the walls of a frame by screws 119 or other suitable fasteners. The engagement of the flanges and the kerfs releasably secures wall member 110 to frame 44 and base 12. A user may sit on cushion 14 and lean against support member 110, and the engagement of the flanges and kerfs retains the tongues 112 within slots 55 for a stable and secure backing for the furniture unit. When it is desired to release support member 110, a user may tilt support member forward slightly (i.e. towards wall 46 in FIG. 7) so that the flanges and kerfs are disengaged, allowing tongues 112 to be to be pulled out of slots 55. It will be appreciated that all of the slots 55 around the walls of a frame will be similarly oriented in the manner shown in FIG. 8A where tongue portion 112 is used on a furniture module such as support member 110.

Figure 9A:
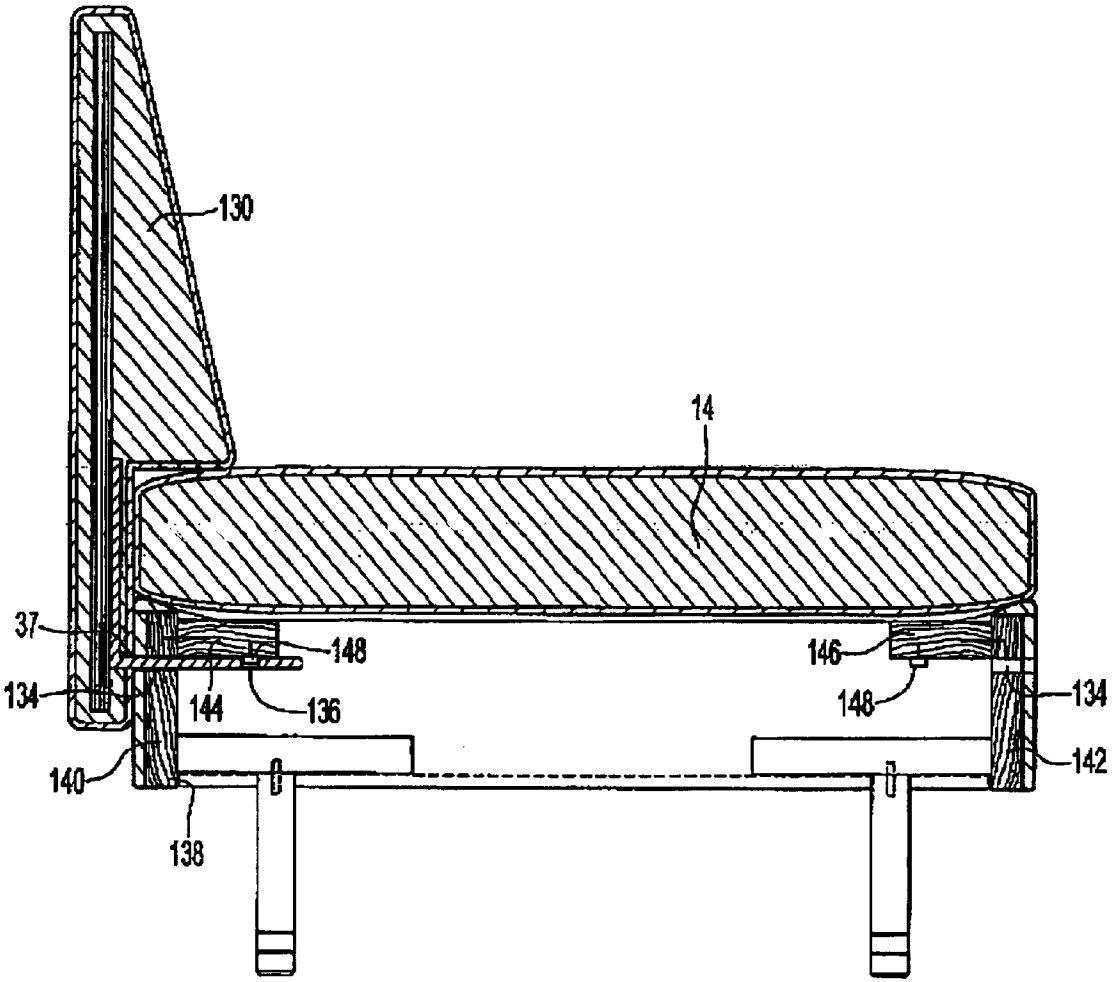
FIG. 9A is a cross section view of a sofa according to this invention such as the sofas illustrated in FIGS. 1 and 2, illustrating another alternative embodiment of the tongue and slot arrangement illustrated in FIG. 5 used to releasably secure a furniture module to the base frame.
Figure 9B:
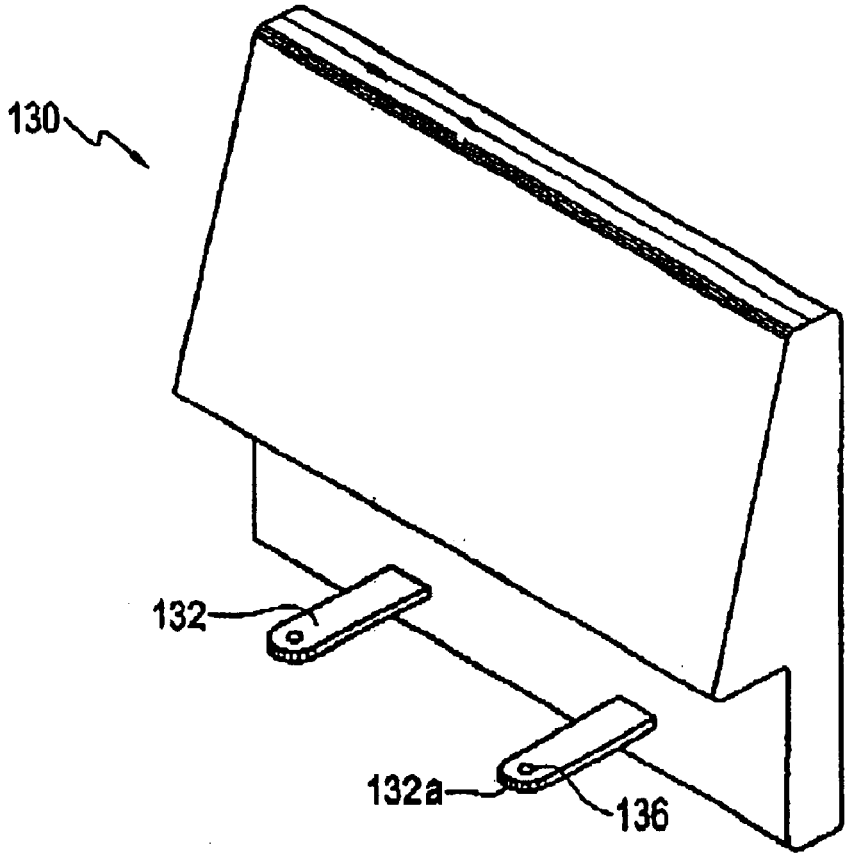
FIG. 9B is a perspective view of the furniture module illustrated in FIG. 9A.

FIG. 9A illustrates another alternative embodiment of the tongue and slot arrangement of FIG. 5. Wall member 130 is similar to wall member 110 in that tongue portion 132 is horizontally oriented. Slots 134 are similarly horizontally oriented. Tongue portion 132 defines an aperture 136 proximal to its free end 132*a* (see also FIG. 9B). Frame 138 includes four interconnected walls, only walls 140, 142 being illustrated in FIG. 9A. Frame 138 also includes four top ties attached to upper parts of the walls of frame 138. Only top ties 144 and 146 (which are attached, respectively, to walls 140, 142) are illustrated in FIG. 9A, though it will be appreciated similar ties will be present to correspond to the walls which are not illustrated in FIG. 9A. The top ties extend perpendicular to the four walls of frame 138. Frame 138 also includes a plurality of circular pins 148 mounted on the undersides of the top ties. Pins 148 are used to engage aperture 136 of tongue portion 132, as shown in FIG. 9A. In operation, tongue portion 132 is inserted into a slot 134. The height of the slots 134 should be slightly larger than the thickness of tongue portion 132. Once free end 132*a* is inserted, the user tilts wall member 130 forward slightly so that free end 132*a* passes beneath pin 148. Once this occurs, the user can push the wall member 130 horizontally forwards with a slight upward lift to insert pin 148 into aperture 136, thereby securing wall member 130 to frame 138. A user may then lean against wall member 130 while sitting on cushion 14. This would act to lever tongue portion 132 upwardly, maintaining the pin 148 within aperture 136. When it is desired to remove wall member 130, a user tilts wall member 130 forward, dropping tongue portion 132 downwards and removing the engagement of pin 140 and aperture 136, allowing tongue 132 to then be pulled from slot 134. Again, it will be appreciated that each of the slots 134 in frame 138 will be horizontally oriented and will have a pin positioned internal of an adjacent slot 134 where tongue 132 is used in a furniture module such as wall member 130.

Figure 10A:
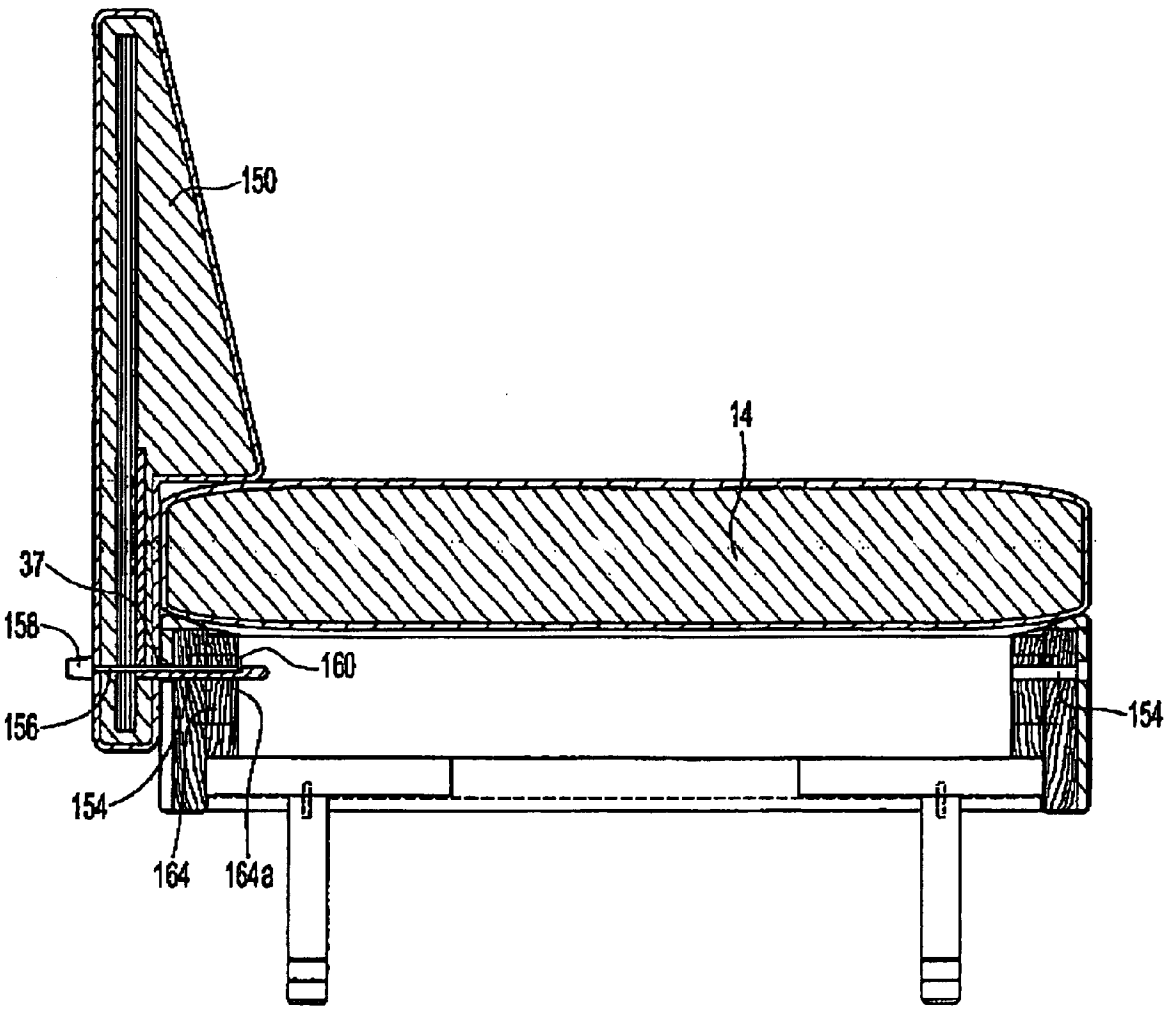
FIG. 10A is a cross section view of a sofa according to this invention such as the sofas illustrated in FIGS. 1 and 2, illustrating another alternative embodiment of the tongue and slot arrangement illustrated in FIG. 5 used to releasably secure a furniture module to the base frame.
Figure 10B:
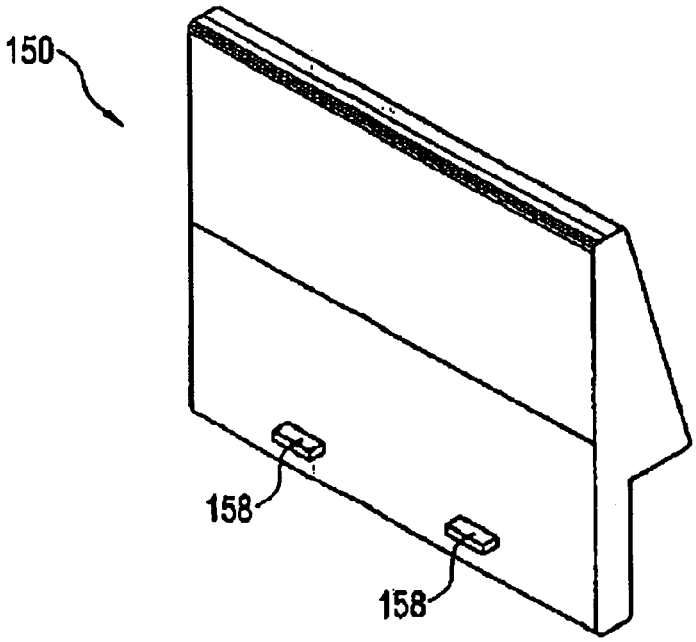
FIG. 10B is a perspective view of the back of the furniture module illustrated in FIG. 10A.
Figure 10C:
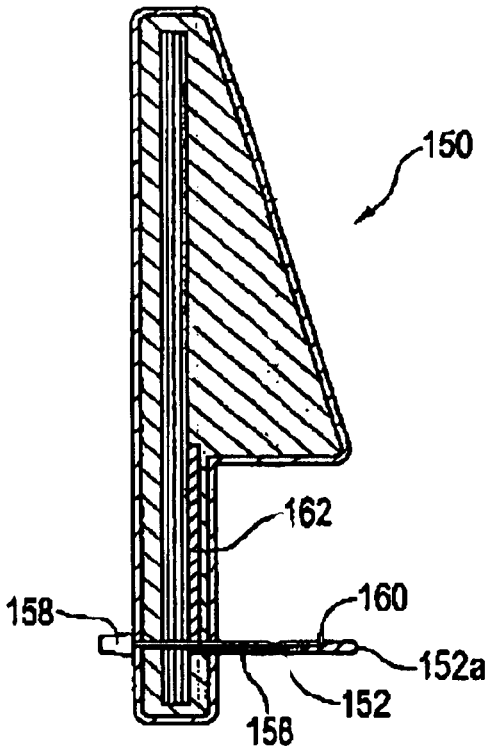
FIG. 10C is a cross section view of the furniture module illustrated in FIGS. 10A.

FIG. 10A illustrates another alternative embodiment of the tongue and slot arrangement of FIG. 5. Wall member 150 includes an L-shaped bar 162 having a horizontally oriented tongue portion 152. Slots 154 are horizontally oriented to accommodate the insertion of tongue portions 152. Support member 150 also includes a rod 156 which has a knob 158 attached at a first end and a locking tab 160 attached at a second end. Rod 156 preferably passes through an aperture in L-shaped bar 162 and preferably sits in a groove (not shown) in the top surface of tongue portion 152 on the longitudinal axis of tongue portion 152. Locking tab 160 has a width which is smaller than the height of slots 154 in order to pass through. Once tongue portions 152 are inserted into slots 154, a user turns knob 158 which turns locking tab 160 perpendicularly to the position shown in FIGS. 10A and 10C to secure support member 150 to the base. The height of turned locking tab 160 is greater than the height of slots 154, thus preventing withdrawal of tongue portion 152 from slots 154, thus securing wall member 150 to the base for secure and stable functioning.

A user may sit on cushion 14 and lean against support member 150, and the turned locking tab 160 bears against the inside surface 164*a* of wall 164 to prevent tongue portion 152 from being removed from slot 154 for a stable and secure backing for the furniture unit. When it is desired to release support member 150, a user may turn knob 158 to return locking tab 160 to its original position to enable tongue 152 to be removed from slot 154. It will be appreciated that all of the slots 154 around the walls of a frame will be similarly oriented in the manner shown in FIG. 10A where a furniture module includes a locking tab arrangement as shown for support member 150 in FIG. 10C.

As will be apparent to those skilled in the art in the light of the foregoing disclosure, many alterations and modifications are possible in the practice of this invention without departing from the spirit or scope thereof.

For example, the invention has been described and illustrated above primarily with reference to a sofa arrangement such as sofa 10 or sofa 30. However, it will be appreciated that any number of different furniture units, such as sofas, chairs, loveseats, sectionals and beds, can be formed according to this invention by using a base having a plurality of slots in its wall(s) as described and illustrated in this disclosure. The base must be capable of releasably securing one or more furniture modules. As used herein the term "furniture module" means any module of furniture that is capable of being releasably secured to a base, and includes arm and side wall members (such as those described herein), armrest or backrest members, members for extend the seating (or lying) capacity of the base (such as rounded extension member 34 or a base member) or a table.

It will also be appreciated that it would be possible to construct a furniture unit using side and back wall furniture modules that were sufficiently padded and dimensioned without the need for additional cushions. For example, the size of the upper portions of wall members 18 could be increased to act not only in a structural capacity but also in a cushioning capacity as well for sofa 10. For example, these support members might be shaped and positioned to act as a backrest or armrest or the like, without the need for additional cushions. These type of arrangements would not require VELCRO™ strips 79 on the wall members.

The furniture modules could have any number of different profiles and shapes, depending upon the appearance sought. This will simply be a matter of adjusting a module's internal frame and foam padding to achieve a desired profile. For example, wall members 18 could alternatively have a round or square profile if that were desired. Many other shapes and profiles could also be achieved.

Similarly, it will be appreciated that this invention is not limited to rectangular base frames like frame 44. This shape has been illustrated for convenience, but the base frame might be constructed with any plurality of walls sufficient to construct a base.

Similarly, cover 36 covering the walls of base 12 has been described with a zipper 40 for providing access to the slots 54 of frame 44. Those skilled in the furniture art will appreciate that other means exist to open and close the slit or gap 37 in the cover for accessing the desired frame slots but otherwise covering the unused slots. For example, strips of self-gripping fabric such as VELCRO™, buttons, snaps or any other closure means known in the textiles art could be used.

The wall members have been described and illustrated herein having two tongue members. However, a different number of tongue members may be used for differently sized furniture modules to secure the module to the base. For example, smaller furniture modules may require only a single tongue, while it may be preferable for stability to use more than two tongues for larger furniture modules.

Wall member 150 has been illustrated and described with locking tab 160 to retain member 150 secure against the base. Other means could alternatively be used. For example, there are many known lock and catch mechanisms such as push latches, rotary catches, push knobs with latches, that could be positioned near the free end of the tongue for engaging a mating portion within the frame. Similarly, the knobs 158 might alternatively be replaced by any number of well known mechanisms to rotate the rod, such as a draw hasp or spring loaded buttons. Also, if it were desired to hide knobs 158 from view, the knobs might alternatively be positioned on the underside of the wall member and attached to a rod via a cam located in the interior of the wall member.

Accordingly, the scope of the invention is to be construed in accordance with the substance defined by the following claims.

What is claimed is:

1. A furniture unit comprising a base for supporting a cushion thereupon, the base comprising a frame, the frame comprising a plurality of interconnected upright walls, at least one wall defining a plurality of slots therethrough, wherein the walls are covered by a cover member, the cover member defining a gap therein for providing access to the plurality of slots, the cover member comprising means for opening and sealing the gap, wherein each of the plurality of slots is dimensioned for insertion of a free end of a tongue portion of a furniture module for releasably securing the furniture module to the base.

2. The furniture unit of claim 1 further comprising at least one furniture module having at least one tongue portion with a free end.

3. The furniture unit of claim 2 comprising a plurality of furniture modules, the plurality of furniture modules each having at least one tongue portion with a free end, wherein the plurality of furniture modules are selected from the group consisting of back wall members, side wall members, armrest members, backrest members, footrest members, seat cushion extension members, base members, tables and combinations of back wall members, side wall members, armrest members, backrest members, footrest members, seat cushion extension members, base members and tables.

4. The furniture unit of claim 3 wherein the base and the plurality of furniture modules are releasably secured to form a bed, sofa, sectional, chair or loveseat.

5. The furniture unit of claim 3 further comprising a plurality of cushions.

6. The furniture unit of claim 2 wherein the plurality of slots extend substantially the length of the at least one wall in a side by side linear arrangement.

7. The furniture unit of claim 2 wherein each of the walls define a plurality of slots therethrough.

8. The furniture unit of claim 7 wherein the plurality of slots extend substantially the length of each of the walls in side by side linear arrangements, and wherein each of the linear arrangements are positioned at a common vertical position on the walls to create a linear arrangement of the plurality of slots extending substantially around the perimeter of the frame.

9. The furniture unit of claim 2 wherein the meant for opening and sealing the gap comprises a continuous two-way zipper having a plurality of pull tabs.

10. The furniture unit of claim 9 wherein the cover member comprises a hanging flap to cover the zipper.

11. The furniture unit of claim 2 wherein the means for opening and sealing the gap comprises strips of self-sealing fabric, buttons or snaps.

12. The furniture unit of claim 2 wherein the plurality of slots and the at least one tongue portion each have a downwardly angled orientation.

13. The furniture unit of claim 12 wherein the plurality of slots and the at least one tongue portion each have an angle of approximately 110°.

14. The furniture unit of claim 2 wherein the frame comprises flanges attached to the walls and positioned on edges of the plurality of slots, and wherein the at least one tongue portion defines at least one kerf for engaging a flange when the free end of the at least one tongue portion is inserted one of the plurality of slots to releasably secure the at least one furniture module to the base.

15. The furniture unit of claim 14 wherein the at least one tongue portion and the plurality of slots are each horizontally oriented.

16. The furniture unit of claim 15 wherein the frame comprises flanges attached to the walls and positioned on opposing edges of each of the plurality of slots and the at least one tongue portion defines two kerfs on its top and both surfaces for engaging the two flanges of one of the plurality of slots when the free end of the at least one tongue portion is inserted into one of the plurality of slots to releasably secure the at least one furniture module to the base.

17. The furniture unit of claim 2 wherein the at leant one furniture module comprises a locking tab positioned near the free end of the at least one tongue portion, the locking tab having a width smaller than the height of one of the plurality of slots and a height greater than the height of one of the plurality of slots, the locking tab being turned perpendicularly to the plurality of a slots by means of a knob on the exterior of the furniture module after insertion of the free end of the at least one tongue portion into one of the plurality of slots to releasably secure the at least one furniture module to the base, the knob being operatively connected to the locking tab by a rod extending through the at least one furniture module.

18. The furniture unit of claim 17 wherein the rod is a straight rod attached at a first end to the knob and attached at a second end to the locking tab.

19. The furniture unit of claim 2 wherein the at least one furniture module is a side wall member or back wall member comprising a rigid frame and a generally L-shaped bar having an upright first portion attached to the at least one tongue portion, the upright first portion being secured to the rigid frame and the at least one tongue portion extending away from the upright first portion.

20. The furniture unit of claim 19 wherein the at least one furniture module comprises two generally L-shaped bars, each generally L-shaped bar having an upright first portion secured to the rigid frame and a tongue portion with a free end.

21. The furniture unit of claim 2 wherein the at least one furniture module comprises two tongue portions, each of the tongue portions having a free end.

22. The furniture unit of claim 2 wherein the frame comprises pins positioned proximal to the plurality of slots the interior of the frame, wherein the at least one tongue portion defines an aperture therein for accommodating the insertion of one of the pins therein when the free end of the at least one tongue portion is inserted into one of the plurality of slots to releasably secure the at least one furniture module to the base.

23. The furniture unit of claim 22, wherein the frame comprises a plurality of top ties attached to and extending from upper portions of the walls of the frame, the pine being attached to and extending downwardly from the ties.

24. The furniture unit of claim 2 comprising means for releasably retaining the at least one tongue portion within at least one of the plurality of slots to releasably secure the at least one furniture module to the frame.

25. The furniture unit of claim 2 wherein the cover member is made from leather or a fabric material.

26. A convertible sofa-bed unit comprising:

a base for supporting a cushion thereupon;

a plurality of side wall members and back wall members, each of the side wall members and back wall members comprising at least one tongue portion having a free end;

wherein the base comprises a frame comprising an upright front wall, an upright rear wall and two interconnecting upright side walls, the rear and side walls each defining a plurality of slots therethrough, each of the plurality of slots being dimensioned to receive the free end of one of the at least one tongue portions to releasably secure the side wall members and back wall members to the base, wherein the walls are covered by a cover member defining a gap for providing access to insert the free ends of the at least one tongue portions into the plurality of slots to releasably secure the side wall members and back wall members to the base, the cover member comprising means for opening and closing the gap; and whereby the unit forms a sofa by releasably securing the side wall members and back wall members to the base through the insertion of the free ends of the at least one tongue portions into the plurality of slots, and wherein the unit forms a bed when the side wall members and back wall members are released from the base by removing the at least one tongue portions from the plurality of slots.

27. A modular furniture system capable of forming a plurality of different furniture unite, comprising:

a base for supporting a cushion thereupon;

a plurality of furniture modules, including back wall members, side wall members, armrest members, backrest members, footrest members, seat cushion extension members, base members, tables and combinations of back wall members, side wall members, armrest members, backrest members, footrest members, seat cushion extension members, base members and tables, each furniture module comprising a tongue portion having a free end;

wherein the base comprises a frame, the frame comprises a plurality of interconnected upright walls, each wall defining a plurality of slots therethrough, each of the plurality of slots being dimensioned to receive the free end of the tongue portions to releasably secure the furniture modules to the base;

wherein one or more of the furniture modules may be releasably secured to the base at a time, and wherein the furniture modules may be repositioned and releasably secured at a plurality of different locations on the base, and wherein the walls are covered by a cover member defining a gap therein for providing access to insert the free ends of the tongue portions into the plurality of slots to releasably secure the furniture modules to the base, the cover member comprising means for opening and sealing the gap.

28. A furniture unit comprising:

a plurality of furniture modules selected from the group consisting of back wall members, side wall members, armrest members, backrest members, footrest members, seat cushion extension members, base members, tables and combinations of back wall members, side wall members, armrest members, backrest members, footrest members, seat cushion extension members, base members and tables, each of the furniture modules comprising two tongue portions, each of the tongue portions having a free end;

a base for supporting a cushion thereupon, the base comprising a rectangular frame comprised of four interconnected upright walls, each wall defining a plurality of slots therethrough in a side by side linear arrangement, and wherein each of the linear arrangements are positioned at a common vertical position on the walls to create a linear arrangement of the plurality of slots extending substantially around the perimeter of the frame, each of the plurality of slots being dimensioned for insertion of one of the free ends of one of the tongue portions of one of the plurality of furniture modules to releasably secure a one of the furniture modules to the base, wherein the walls are covered by a cover member, the cover member defining a gap therein for providing access to insert the free ends of the tongue portions into the plurality of slots to releasably secure the furniture modules to the base, the cover member comprising means for opening and sealing the gap at selected locations; and wherein the plurality of slots and the tongue portions each have a downwardly angled orientation.

* * * * *